US005185802A

United States Patent [19]

Stanton

[11] Patent Number: 5,185,802

[45] Date of Patent: Feb. 9, 1993

[54] MODULAR HEARING AID SYSTEM

[75] Inventor: Mark F. Stanton, Mundelein, Ill.

[73] Assignee: Beltone Electronics Corporation, Chicago, Ill.

[21] Appl. No.: 875,531

[22] Filed: Apr. 27, 1992

Related U.S. Application Data

[63] Continuation of Ser. No. 547,625, Jul. 2, 1990, abandoned, which is a continuation-in-part of Ser. No. 508,775, Apr. 12, 1990, abandoned.

[51] Int. Cl.[5] ..... H04R 25/00

[52] U.S. Cl. ..... 381/68.6; 381/69; 181/129

[58] Field of Search ..... 381/60, 68, 68.6, 69, 381/150, 154; 181/129

[56] References Cited

U.S. PATENT DOCUMENTS

| | | | |
|---|---|---|---|
| 3,345,737 | 10/1967 | Gordon | 381/68.6 |
| 3,475,528 | 10/1969 | Parks . | |
| 4,617,429 | 10/1986 | Bellafiore | 264/222 |
| 4,712,245 | 12/1987 | Lyregaard | 381/68.6 |
| 4,716,985 | 1/1988 | Haertl | 181/130 |
| 4,739,512 | 4/1988 | Hartl et al. | 381/68.6 |
| 4,811,402 | 3/1989 | Ward | 381/68.6 |
| 4,828,777 | 5/1989 | Birkholz | 264/139 |
| 4,834,927 | 5/1989 | Birkholz et al. . | |
| 4,840,249 | 6/1989 | Birkholz et al. | 181/129 |
| 4,852,177 | 7/1989 | Ambrose | 381/154 |
| 4,870,688 | 9/1989 | Voroba et al. | 381/60 |
| 4,879,750 | 11/1989 | Nassler | 381/68.6 |

FOREIGN PATENT DOCUMENTS

| | | | |
|---|---|---|---|
| 1487272 | 3/1969 | Fed. Rep. of Germany | 381/68.6 |
| 648172A5 | 2/1985 | Switzerland | 381/68.6 |

OTHER PUBLICATIONS

Oticon I11 Modular ITE Aids, "Impression Taking Procedure".

Oticon I11 Modular ITE Aids, Hard Ear Mold Process, Soft Ear Mold Process.

*Primary Examiner*—Curtis Kuntz
*Assistant Examiner*—William Cumming
*Attorney, Agent, or Firm*—Dressler, Goldsmith, Shore, Sutker & Milnamow, Ltd.

[57] ABSTRACT

A modular hearing aid system has an exterior shell and a removable interior housing. The shell can be customized for a user's right or left ear. The housing has a standard, bilateral shape useable with either ear. The housing can be removably locked to the shell. A vent channel is molded into the shell adjacent a region of the housing.

4 Claims, 10 Drawing Sheets

FIG. 1
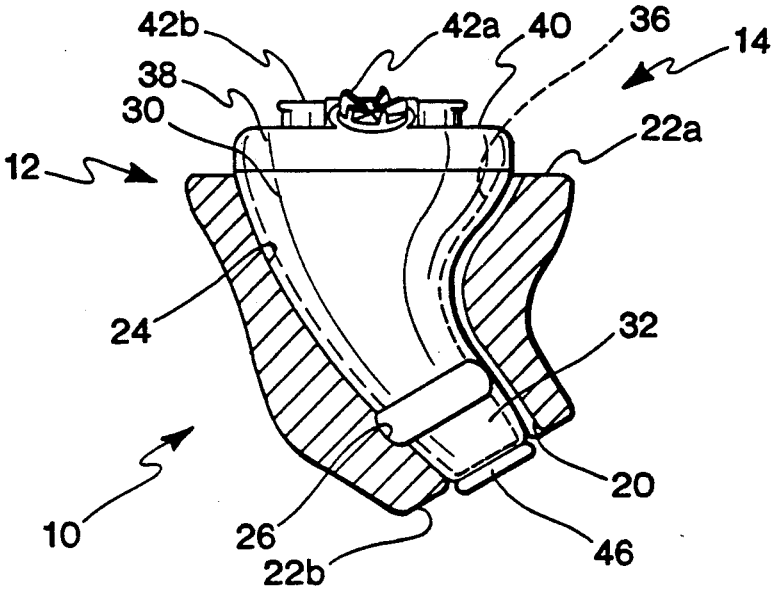
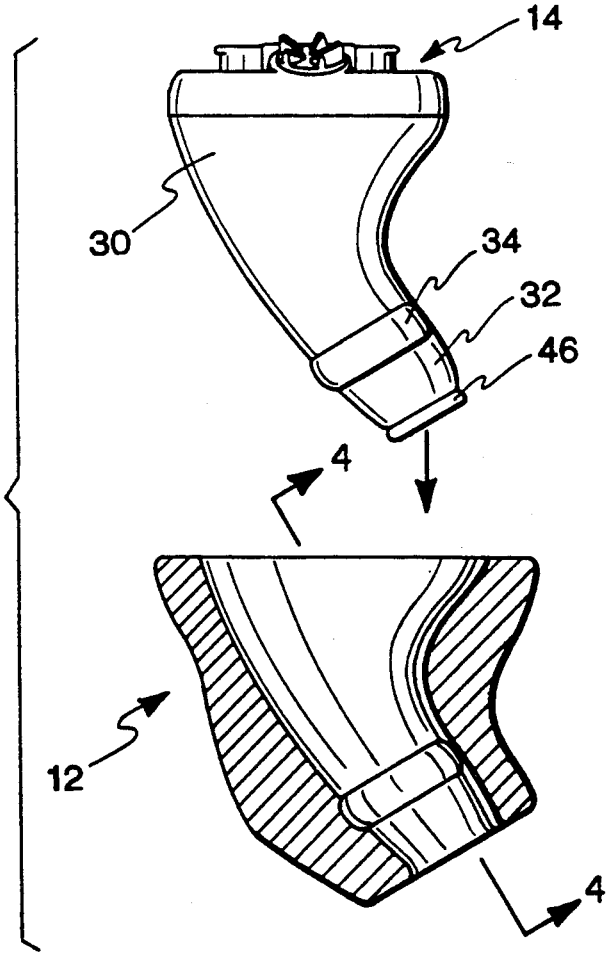
FIG. 2

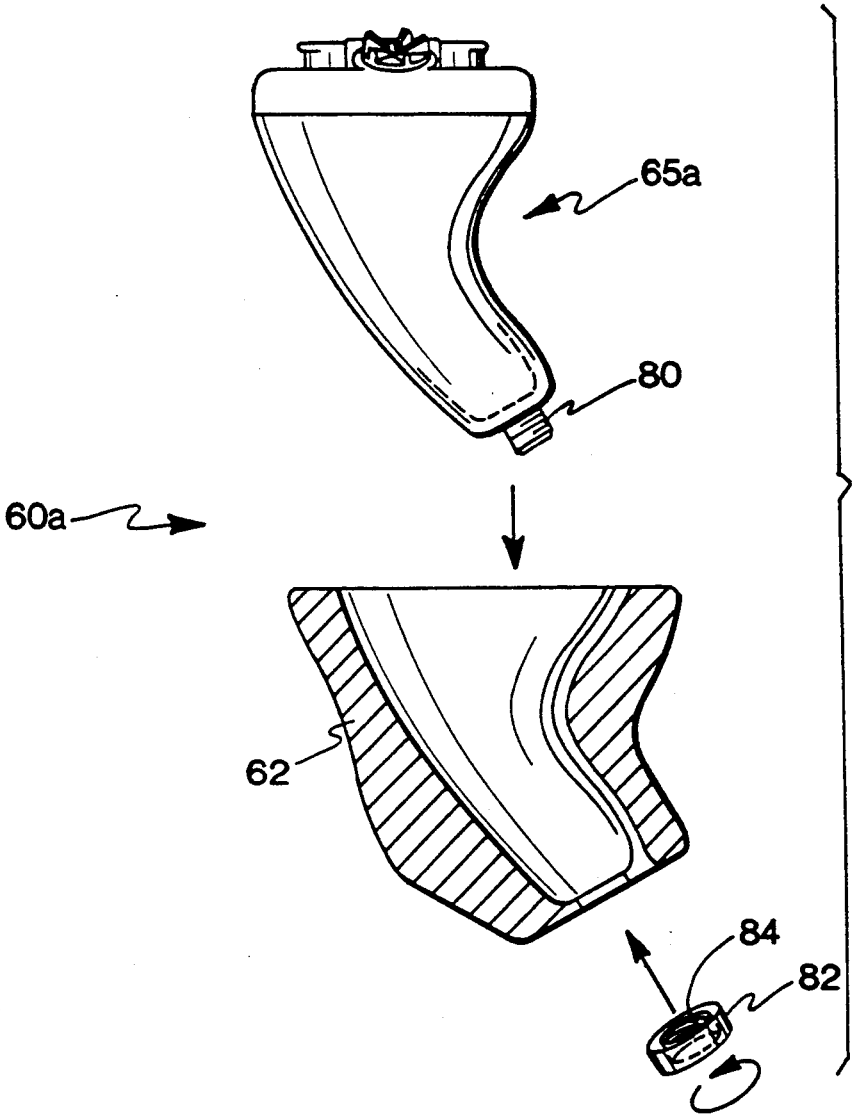
FIG. 11
FIG. 12
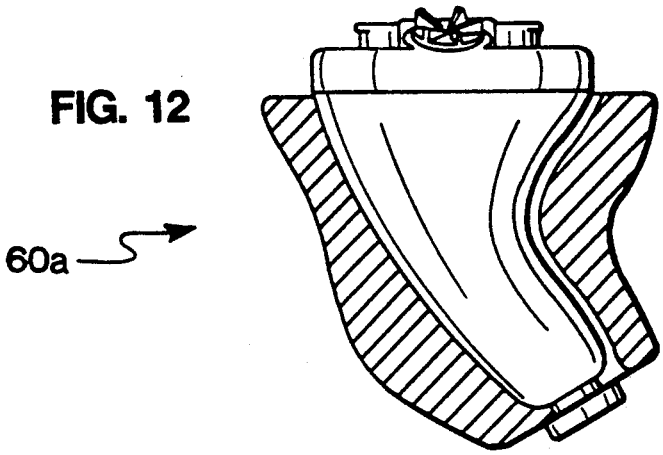

MODULAR HEARING AID SYSTEM

This is a continuation of application Ser. No. 07/547,625, filed Jul. 2, 1990, now abandoned.

Which is a continuation-in-part of U.S. patent application Ser. No. 508,775 filed Apr. 12, 1990 now abandoned.

FIELD OF THE INVENTION

The invention pertains to hearing aids. More particularly, the invention pertains to modular hearing aid systems which can be positioned in an individual's ear.

BACKGROUND OF THE INVENTION

Hearing aids of various types have long been known. Some known prior art hearing aids have been formed with a custom exterior shell molded with a cavity therein. The components of the hearing aid can be mounted in the cavity thereby forming a structure which fits comfortably in the ear and in part extends into the user's ear canal.

It has been recognized that mounting the components directly within the custom shell presents test and maintenance problems. For purposes of manufacturing, testing and maintenance, it would be very desirable to be able to remove the interconnected components completely from the custom shell and immediately replace same with a corresponding set. Where the hearing aid is physically built into the custom shell, this is usually not possible.

Modular hearing aid systems are known which include a custom shell with a cavity or region formed therein and a compatibly shaped housing. One such product of this type was marketed in the United States at least as early as 1978 by the Oticon Corporation.

The Oticon system utilized a custom shell and a standard housing which could be releasably locked to the shell. The Oticon system used a different housing for the right ear versus the left ear.

In the Oticon system, after the custom shell had been formed, a vent was created in the shell by drilling the shell material appropriately.

While known prior art modular hearing aid systems provide certain benefits, it would be especially desirable to be able to use the same housing for either a right ear or a left ear. In addition, it would be desirable to be able to form the vent canal as an integral part of the unit during the shell casting process without having to separately drill same.

Thus, there continues to be a need for modular hearing aid systems which provide features and benefits of the type described above not heretofore available in such products.

SUMMARY OF THE INVENTION

A modular hearing aid system incorporates a custom molded shell insertable into either the right ear or the left ear of an individual. The shell can be custom molded of either a compliant or a rigid material.

The shell is formed with a proximal, exterior end; a distal, interior end and with an interior housing receiving region therebetween. Adjacent the distal end of the shell is an opening.

A corresponding housing has a selected standardized, elongated shape. The housing has an enlarged or bulbous proximal end and a displaced smaller distal end.

The housing is shaped so as to be bilateral. The same housing may be used with an ear shell formed for an individual's right ear or an individual's left ear.

The housing is releasably locked to the shell. In one embodiment, the housing carries part of the releasable locking member and the shell carries a second part thereof. When the two parts engage one another, the housing is releasably locked to the shell.

The system also includes a molded elongated vent formed in the shell adjacent an interface with the housing. The vent extends from the distal end of the shell, located in the individual's ear canal, to the proximal end of the shell.

The system can be formed with the engaging member completely contained within the shell when the housing is locked thereto. Alternately, the housing can carry, at the smaller distal end, the first part of the latching member. This member will extend through the opening in the shell (when the housing has been properly positioned therein). A snap-on or threaded second part can be coupled to the first part thereby locking the housing to the shell.

Alternately, the housing can carry an enlarged annular region along its external periphery. In this embodiment, the shell includes a corresponding annular recess. When the housing is inserted into the shell the annular region extends into and is locked to the shell at the recess.

Instead of a singular annular member carried on the housing, a plurality of spaced-apart laterally directed extensions or protrusions can be positioned around the external periphery of the housing. Corresponding depressions or cavities can be formed in the shell. When the housing is inserted into the shell, the extensions lockingly engage the shell at the depressions.

In one embodiment, the annular region can be located adjacent to proximal end of the housing. In another embodiment, the annular region can be located adjacent the distal end of the housing.

The housing is also usable with a customer ear shell or one or more standard shells as an alternate to a custom shell.

Numerous other advantages and features of the present invention will become readily apparent from the following detailed description of the invention and the embodiments thereof, from the claims and from the accompanying drawings in which the details of the invention are fully and completely disclosed as a part of this specification.

BRIEF DESCRIPTION OF THE FIGURES

FIG. 1 is a side view, partly in section, illustrating a modular hearing aid system in accordance with the present invention;

FIG. 2 is an exploded view of the structure of FIG. 1;

FIG. 11 is an exploded view, partly in section, of yet another alternate modular hearing aid system;

FIG. 12 is an assembled side view, partially in section, of the system of FIG. 11;

DETAILED DESCRIPTION OF THE PREFERRED EMBODIMENTS

Figure 3:
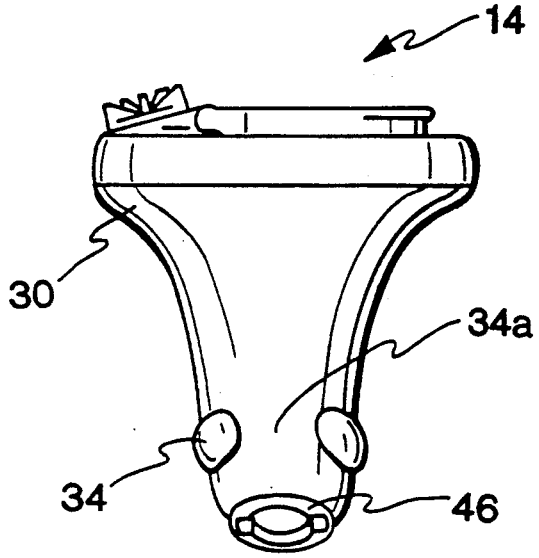
FIG. 3 is a side plan view of a standardized housing in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiment illustrated.

A two-part modular hearing aid system 10 in accordance with the present invention is illustrated in FIG. 1. The system 10 includes an outer custom shell 12 and an inner standard housing 14.

The outer shell 12 reproduces and is in accordance with the shape of the ear canal of either the right ear or the left ear of the individual for whom the hearing aid is created. Hence, a separate and distinct shell is used for each ear.

The process of creating such shells is well known. One type of compliant material useable for such shells is marketed by Esschem Company under the trademark of AUDIFLEX.

The shell 12 includes a molded vent channel 20. The vent channel 20 is molded into the shell 12 adjacent an interface with the housing 14. It will be understood that the shell 12 could be molded without the vent.

The shell 12 is formed with an external or a proximal end 22*a* and an internal or distal ear canal end 22*b*. When inserted, the distal end 22*b* is located in the ear canal of the individual using the aid.

The shell also includes an interior region 24 which has a shape that corresponds to the exterior shape of the housing 14. An annular surface or depression 26 is formed in the region 24. This surface is part of the housing locking means.

The housing 14, has a selected, elongated shape with a bulbous proximal end 30 and a smaller displaced distal end 32. The end 32 is positioned adjacent the distal end 22*b* of the shell.

The housing 30 is also formed with an external annular locking member 34. The surface 26 and the locking member 34 releasably engage one another so as to lock the housing 14 to the shell 12. It will be understood that these two elements could be interchanged without departing from the spirit and scope of the present invention.

Figure 4:
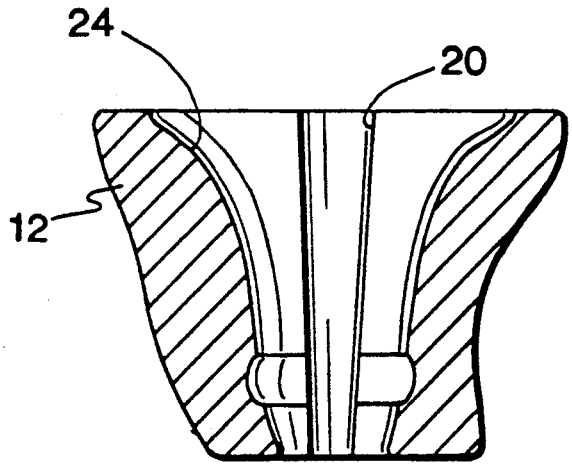
FIG. 4 and 4A is a section taken along plane 4—4 of a portion of FIG. 2.
Figure 4A:
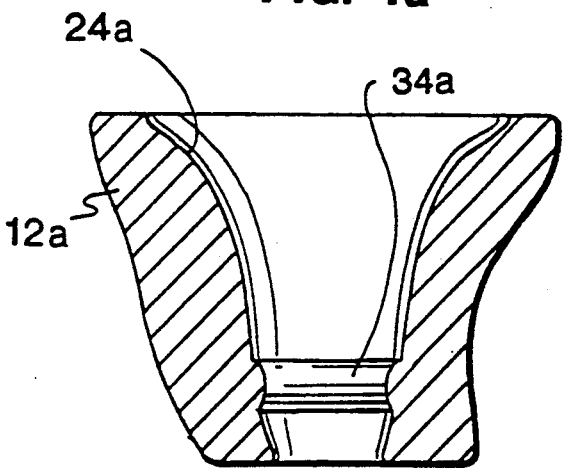

FIG. 4(*a*) illustrates a shell 12(*a*) with an interior region 24(*a*). An annular locking member 34(*a*) is illustrated therein extending from the shell 12(*a*).

The housing 14 is formed with an internal component carrying region 36, illustrated in phantom in FIG. 1. The proximal end 30 is closed by a cover 38. A top surface 40 of the cover 38 carries a volume control 42*a* and a battery chamber top 42*b*.

As noted previously, the housing 14 is shaped to be bilateral and usable with either the right ear or the left ear of an individual. This provides an important benefit from a manufacturing and an inventory control perspective.

The distal end 32 of the housing 14 terminates in a removable wax guard 46. The wax guard 46 can be unscrewed from the distal end 32 or can be unsnapped therefrom.

FIG. 2 illustrates the housing 14 being inserted into the shell. As illustrated in FIG. 2, the shell 12 can be removably locked together with the housing 14 by means of the two-part mechanism including surface 26 and annular ring 34.

FIG. 3, a side view of the housing 14 illustrates the discontinuous nature of the annular locking member 34. The discontinuity in region 34*a* provides an interface surface along which the vent channel 20 extends as illustrated in FIG. 4.

Figure 5:
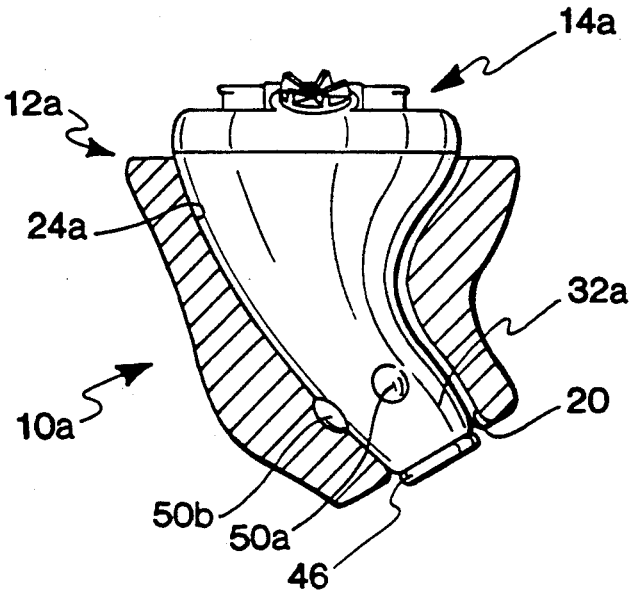
FIG. 5 is a side view, partially in section, of an alternate embodiment of a system in accordance with the present invention.

FIG. 5 illustrates an alternate modular system 10*a* formed of a custom ear shell 12*a* and a standard, bilateral housing 14*a*. The housing 14*a* is removably locked to the compliant shell 12*a* by means of a plurality of locking protrusions 50*a*, 50*b* and 50*c* carried on an exterior surface of the housing 14*a* adjacent distal end 32*a*. Each member of the plurality protrusions 50*a*, 50*b* and 50*c* is received in a depression 52*a*, 52*b* and 52*c* formed on an interior surface of the region 24*a* of the shell 12*a*.

Figure 6:
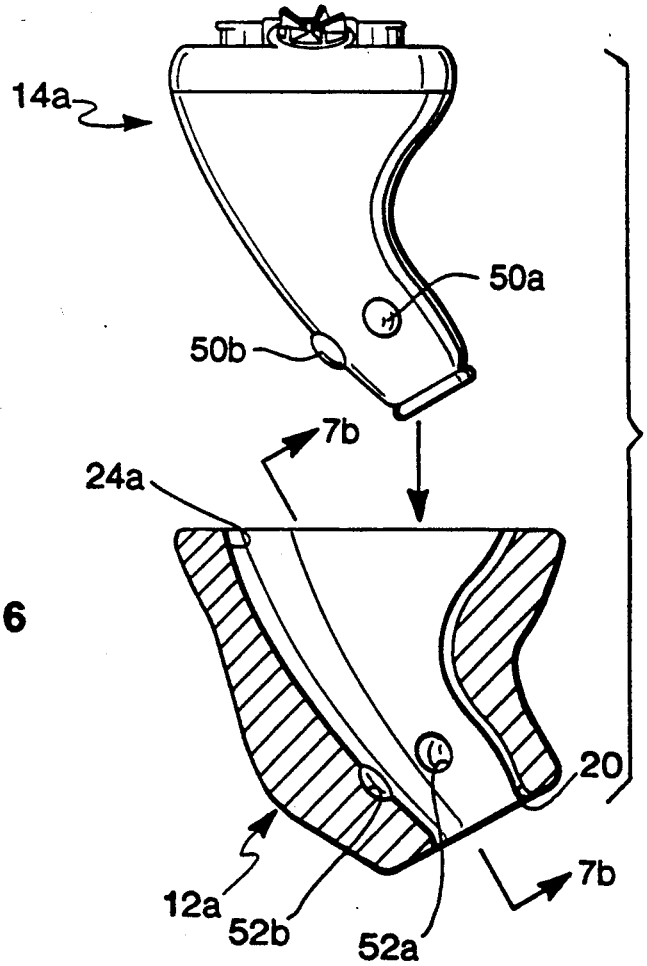
FIG. 6 is an exploded view of the modular hearing aid system of FIG. 5 illustrating the relationship between a housing thereof and a custom shell thereof.

As illustrated in FIG. 6, when the housing 14*a* is inserted into the region 24*a*, the protrusions 50*a*, 50*b* and 50*c* slide into and lock against depressions 52*a*, 52*b* and 52*c*. It will be understood that the protrusions 50*a*, 50*b* and 50*c* could be interchanged with the depressions 52*a*, 52*b* and 52*c* without departing from the spirit and scope for the present invention.

Figure 7A:
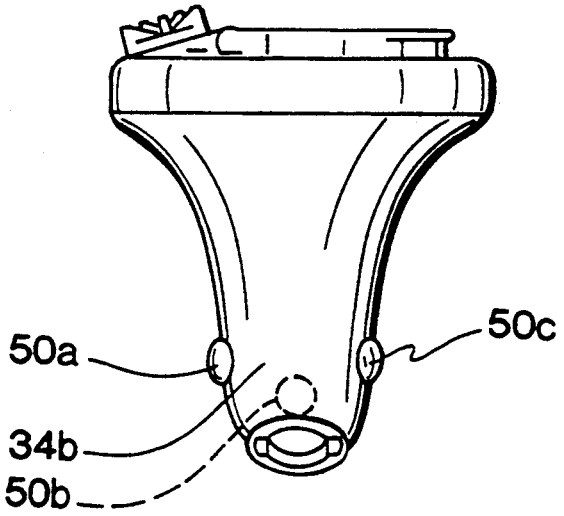
FIG. 7A is a view in section taken alone plane 7A—7A of the shell of FIG. 6.
Figure 7B:
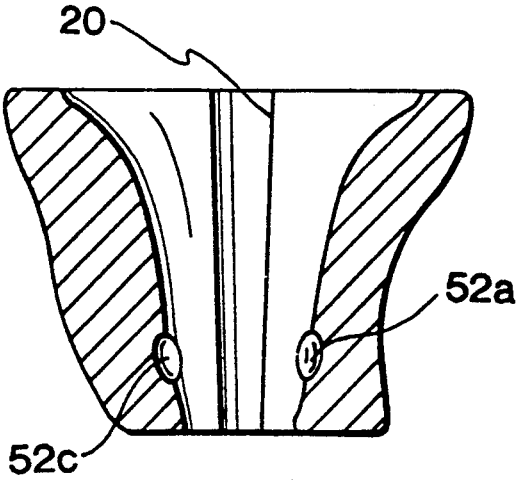
FIG. 7 is a side plan view of the housing of FIG. 5.
Figure 8:
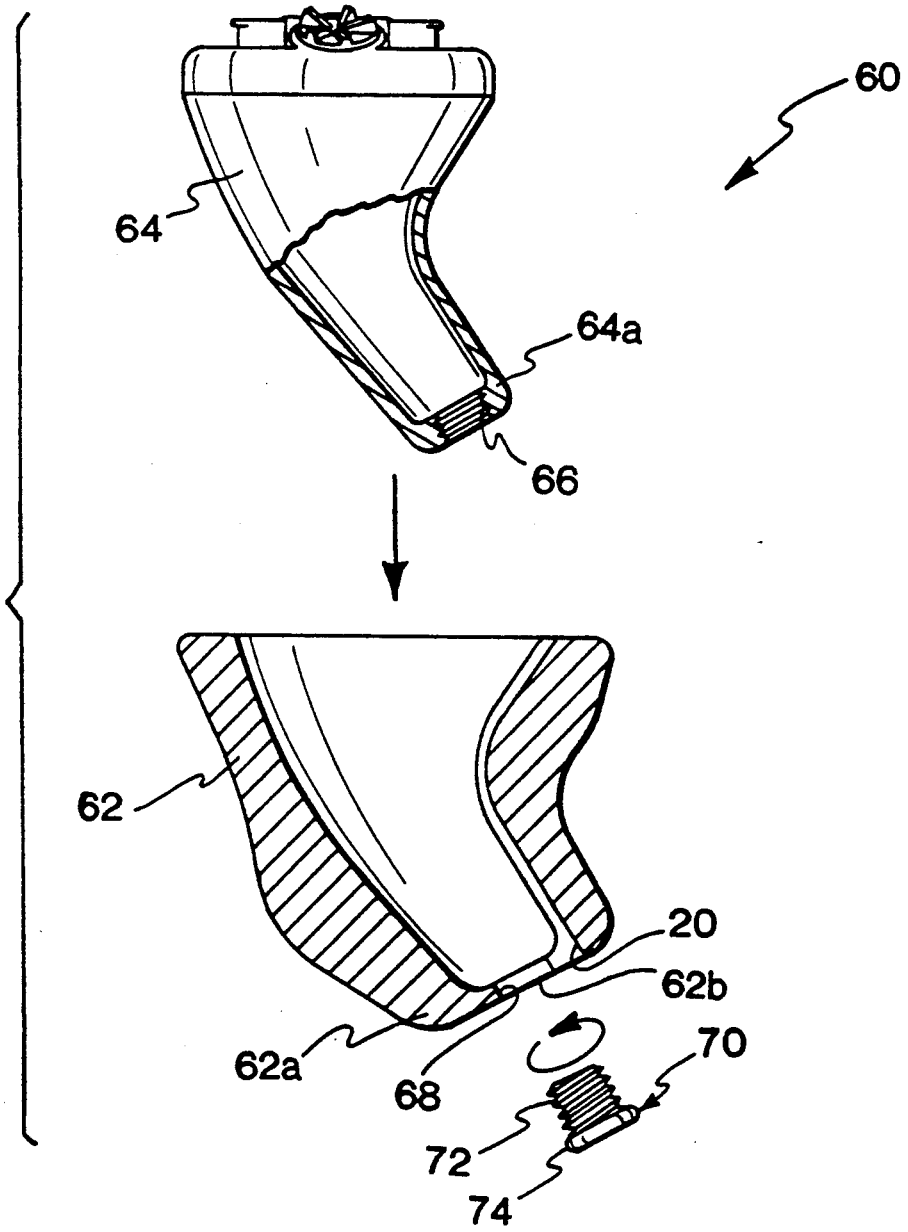
FIG. 8 is an exploded view, partially in section and partially broken away of an alternate embodiment.

FIG. 7(*a*) illustrates the relationship of the protrusions 50*a*, 50*b* and 50*c* with respect to the outer circumference of the housing 14*a*. FIG. 8 illustrates the relationship of the vent channel 20 to the two adjacent locking depressions 52*a* and 52*c*.

As illustrated in FIGS. 7(*a*) and (*b*) the locking protrusions 50*a*, 50*b* and 50*c* are spaced from one another around the housing 14*a* on the order of 90°. The approximate 180° spacing between the protrusions 50*a* and 50*c* provides a region, 34*b* across which the channel 20 can pass.

An alternate modular hearing aid system 60 is illustrated in FIG. 8. The system 60 includes a custom ear shell 62 and a standardized housing 64. The shell 62 and housing 64 are removably latched together by a threaded locking means.

The locking means includes a threaded boring 66 formed at the smaller or distal end 64*a* of the housing 64. It also includes an opening 68 formed at the smaller distal end 62*a* of the shell 62.

Finally, the locking means includes a wax guard 70 which has a threaded stem 72. The stem 72 engages threads 66. Wax guard 70 also includes an enlarged retaining member 74 which, when the system 60 is assembled, bears against distal end surface 62*b* of the shell 62 thereby locking the assembly together.

Figure 9:
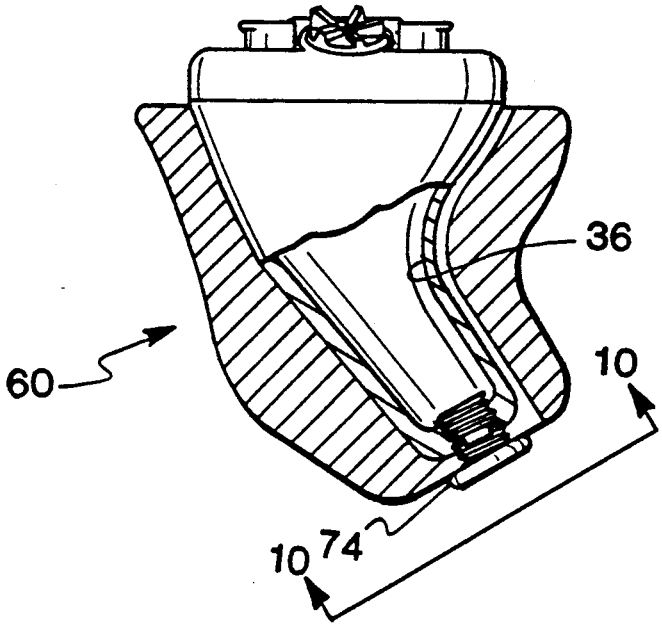
FIG. 9 is an assembled view, partially in section and partially broken away of the system of FIG. 8.
Figure 10:
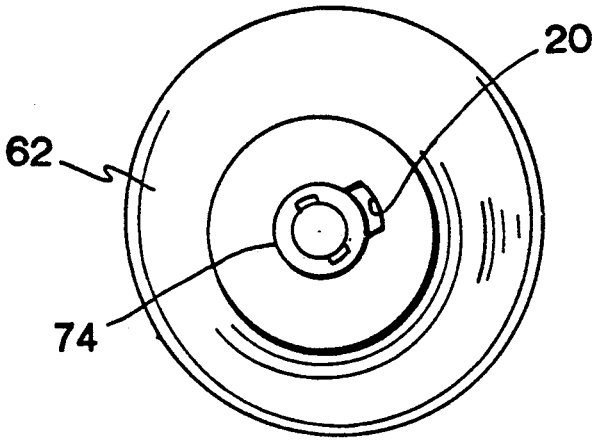
FIG. 10 is a bottom plan view of the system of FIG. 8.

FIGS. 9 and 10 are alternate views of the system 60.

FIGS. 11 and 12 illustrate an alternate embodiment 60*a* of the system 60. The system 60*a* includes a standard housing 65*a* which carries a threaded member 80 extending from a distal end thereof. A ring shaped wax guard 82 carries an internal threaded boring 84 which rotatably engages stem 80 so as to lock housing 65*a* into the corresponding shell 62. Guard 82 bears against the distal end of the shell 62.

Figure 13:
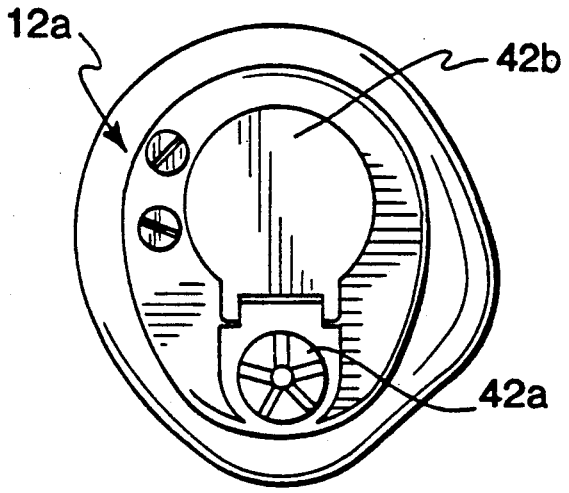
FIG. 13 is a top plan view of the modular hearing aid system of FIG. 5.
Figure 14:
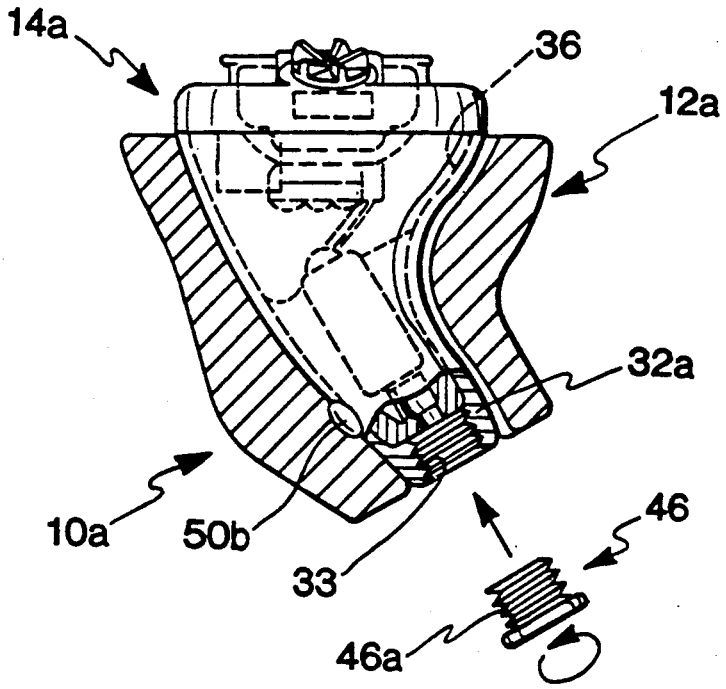
FIG. 14 is an assembled side view, partially in section, of the modular hearing aid system of FIG. 5 illustrating a threaded wax guard which rotatably engages a threaded boring in the standard housing.

FIG. 13 is a top plan view of system 10*a* of FIG. 5. FIG. 14 is a side view of system 10*a* illustrating threaded wax guard 46. Guard 46 has a threaded stud 46*a* which rotatably engages boring 33 of the housing 14*a*. FIG. 14 also illustrates, in phantom, various components carried in the internal region 36 of housing 14*a*.

It will be understood in all instances, as is standard, that an audio path is provided from the distal end of each of the above described standard housings such that amplified sound is injected into the user's ear canal. In this regard, the above described guards also include audio paths so as not to interfere with the passage of sound generated by the hearing aid and intended to be injected into the user's ear canal.

Figure 15:
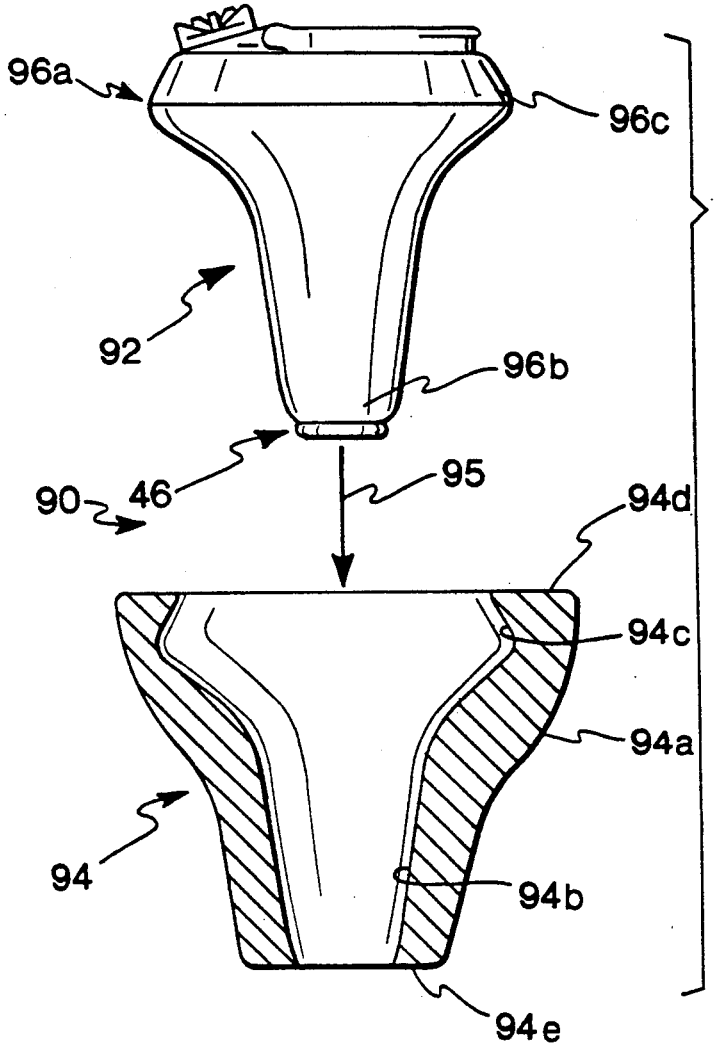
FIG. 15 is an enlarged, side plan view, partly in section of an alternate modular hearing aid system in accordance with the present invention.

FIG. 15 illustrates an alternate modular system 90 having a standard bilateral housing 92 and a custom ear shell 94. The housing 92 has an enlarged external proximal end indicated generally at 96*a* and a smaller distal end 96*b*.

The proximal end 96*a* has formed thereon a locking annular region 96*c*. The illustrated annular region 96*c* extends continuously about the proximal end 96*a*. Alternately, the region 96*c* can extend partly around the region 96*a* or can be formed of a plurality of spaced apart protruding members carried on the region 96*a*.

The shell 94 is formed with an exterior peripheral surface 94*a* which conforms to the shape of the ear of the intended user of the system 90. The shell 94 also includes an internal region 94*b*.

The housing 94 can be inserted into the region 94*b* as illustrated by arrow 95. The internal region 94*b* includes an annular depression 94*c* located adjacent a proximal end 94*d* of the shell 94. The shell 94 also includes a distal end 94*e*.

When the shell 94 is inserted into the user's ear, the distal end 94*e* extends toward the auditory canal and the ear drum of the user.

Figure 16:
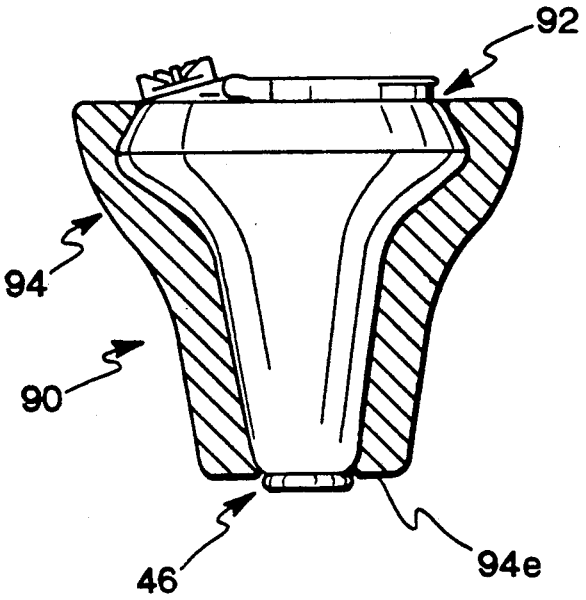
FIG. 16 is an enlarged, side plan view, also partly in section, of the modular hearing aid system of FIG. 15 illustrating a housing lockingly engaged with a corresponding ear shell.

When the housing 92 is received within the shell 94, the external locking region 96*c* slidably engages the retaining region 94*c* of the shell thereby removably locking the housing to the shell as illustrated in FIG. 16. As illustrated in FIG. 16, when the housing 92 is locked to the shell 94, the wax guard 46 extends from the shell adjacent to the distal end 94*e*.

It will be understood that the previously discussed modular hearing aid system could utilize one or more standard rather than custom ear shells. The standard ear shells could be used for testing or evaluation if desired.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A modular hearing aid system comprising:

an elongated housing with a first end displaced from a second end; said housing being shaped so as to be usable with a right ear or a left ear;

a latching element, formed as an annular ring, carried on said housing displaced from second end;

an ear specific shell defining a second end receiving region therein with said second end of said housing receivable therein;

a recessed surface, defined on said shell within said receiving region and engageable with said annular ring; and a vent channel molded in said shell along an interface region between said shell and said housing with said annular ring and said recessed surface cooperating internally within said shell to releasably latch said housing to said shell.

2. A system as in claim 1 with said shell defining an opening extending therethrough adjacent to said receiving region.

3. A system as in claim 2 including a cylindrical guard carried on said second end and extending, at least in part, through said opening.

4. A modular hearing aid system, usable with either a right ear or a left ear of an individual, comprising:

a shell with a proximal end and a distal end insertable into one of a right ear or a left ear, said shell defining an interior region, said region terminating at said distal end at an audio output opening;

a housing usable with either ear, said housing having an elongated shape with a proximal end and a distal end wherein said distal end is insertable into and retained substantially within said region;

a first part of a latch formed as a protrusion on said housing displaced from said distal end and a second part of a latch formed as a recessed surface on said shell within said region, displaced from said distal end wherein said parts of said latch releasably engage one another within said shell when said distal end of said housing is inserted into said internal region of said shell.

* * * * *